United States Patent [19]

Dosaj et al.

[11] Patent Number: 4,898,712

[45] Date of Patent: Feb. 6, 1990

[54] TWO-STAGE FERROSILICON SMELTING PROCESS

[75] Inventors: Vishu D. Dosaj; James B. May, both of Midland, Mich.; Robert D. Jeffress, Palo Alto, Calif.

[73] Assignee: Dow Corning Corporation, Midland, Mich.

[21] Appl. No.: 325,850

[22] Filed: Mar. 20, 1989

[51] Int. Cl.[4] ..... C22C 33/00

[52] U.S. Cl. ..... 420/578; 420/581; 75/10.22; 75/10.38; 75/10.44; 75/10.63; 75/38; 266/185

[58] Field of Search ..... 420/578, 581; 75/10.22, 75/10.38, 10.44, 10.63, 38; 266/185

[56] References Cited

U.S. PATENT DOCUMENTS

| | | | |
|---|---|---|---|
| 1,171,719 | 2/1916 | Harrison | 75/10.38 |
| 3,140,168 | 7/1964 | Halley et al. | 75/40 |
| 4,526,612 | 7/1985 | Eriksson et al. | 420/117 |

*Primary Examiner*—Melvyn J. Andrews
*Attorney, Agent, or Firm*—James E. Bittell

[57] ABSTRACT

The present invention relates to a process for the production of ferrosilicon in a closed two-stage reduction furnace. In the present invention, carbon monoxide released as a result of the smelting process, in the first stage of the furnace, is used to prereduce higher oxides of iron, for example $Fe_2O_3$ and $Fe_3O_4$, contained in a second stage of a furnace, to iron monoxide (FeO). The iron monoxide is then used as a feed material to the first stage of the furnace. The use of a closed furnace and a pre-reduction process results in substantial energy savings in the production of ferrosilicon alloy.

28 Claims, 1 Drawing Sheet

TWO-STAGE FERROSILICON SMELTING PROCESS

BACKGROUND OF THE INVENTION

This invention relates to a process for the production of ferrosilicon in a closed two-stage reduction furnace. In the present invention, carbon monoxide released as a result of the smelting process, is used to prereduce higher oxides of iron, for example $Fe_2O_3$ and $Fe_3O_4$, to iron monoxide (FeO). The use of a closed furnace and a pre-reduction process results in substantial savings both in energy utilization and the cost of certain feed materials.

In the manufacture of ferrosilicon today with greater than about 45% silicon content, an open electric furnace utilizing a submerged arc as an energy source is typically used. This process requires feed materials to be in lump form to prevent the positive pressure, which forms around the electrode, from venting the feed materials from the reaction zone. In this process silicon ($S_i$) is typically prepared by the carbothermic reduction of silicon dioxide ($SiO_2$) with carbonaceous reducing agents. The overall reduction reaction for silicon dioxide to silicon metal can be represented by the equation $$SiO_2+2C=Si+2CO. \quad (1)$$

Iron is typically added to the molten silicon of this process in the form of small steel scraps or filings to form ferrosilicon alloy. Alternatively, iron can be added to the process as oxides which are reduced to elemental iron as follows:

$$Fe_2O_3+3C=2Fe+3CO \quad (2)$$

$$FeO+C=Fe+CO \quad (3)$$

However, iron oxides are typically not used in this process even though inexpensive sources such as ore concentration tailings are available. A major reason is because of the high energy consumption required to reduce the iron oxides to elemental iron.

Present commercial furnaces used in the production of ferrosilicon alloy are estimated to consume approximately three times the theoretical amount of energy needed to effect the reduction of silicon dioxide to silicon. Approximately 50 percent or more of the energy input to this reduction process can be accounted for in the carbon content of the carbonaceous reducing agents. Much of this energy is presently lost as gaseous by-products, mainly carbon monoxide (CO).

Theoretically, if the carbon monoxide lost from the carbothermic reduction of silicon dioxide was used to prereduce the oxides of ore tailings, for example taconite, as great as 0.47 kWh of electricity per kilogram of reduced iron could be achieved. This energy savings along with inexpensive sources of iron oxides such as ore tailings could result in significant savings in the production of ferrosilicon. The tailings could also serve as an inexpensive source of silicon dioxide.

Udy, U.S. Pat. No. 2,637,648, issued May 5, 1953, discloses a process for producing ferrosilicon in an electric furnace. The process uses silicates of a base metal of the group consisting of magnesium, aluminum, potassium, sodium and lithium as a source for the silicon metal. Iron is provided in the form of metallic scrap or the form of iron oxide such as iron ore. The minerals are smelted in the presence of a carbonaceous reducing agent such as, for example, coke.

Eriksson et al., U.S. Pat. No. 4,526,612, issued July 2, 1985, discloses a process comprising introducing a starting material containing a powdered silica-containing material and a powdered iron-containing material, with a carrier gas, into a plasma gas generated by a plasma generator. The heated silica and iron-containing material along with the plasma gas are introduced into a reaction chamber surrounded substantially on all sides by a solid reducing agent in lump form, thereby bringing the silica to molten state and reducing it to silicon which combines with the iron to form ferrosilicon. The iron containing material may be iron oxide. No mention is made of a prereduction step for the iron oxide.

Wilson et al., U.S. Pat. No. 3,704,114, issued Nov. 28, 1972, describes a process for preparing ferrosilicon in an electric arc furnace. The process uses an agglomerated feed material consisting of a particulated silica comprising a fine fraction and a course fraction, a particulate carbonaceous reducing agent, and a particulate iron-bearing material.

Herold et al., U.S. Pat. No. 4,450,003, issued May 22, 1984, discloses a process for recovering combustible gases, in a single-stage, open electrometallurgy furnace, by means of a suction apparatus. Herold suggests the recovered gases can be used by any known process immediately or after a period of deferment, and in particular for preheating or prereducing the components of the furnace charge before they are introduced into the furnace. This patent does not teach a two-stage closed furnace process for prereducing of higher oxides of iron.

Johansson, U.S. Pat. No. 4,269,620, issued May 26, 1981, discloses a two-zone furnace used in a process for the production primarily of silicon metal. The zone of energy supply is divided into a first zone, essentially free from silicon and silicon carbide, and a second zone essentially containing silicon and silicon carbide. Silicon raw material together with reducing agent is charged to the first-mentioned zone and the product gases are conveyed into contact with the second zone wherein the SiO is further reduced to SiC. Mention is made that ferrosilicon can be made by adding iron or iron oxide to the process. No attempt is reported to prereduce the iron oxide with carbon monoxide.

Dosaj et al., co-pending U.S. Pat. No. 239,144, filed Aug. 31, 1988, discloses a cyclic two-step batch operation in a furnace to which a shaft containing a bed of carbon is affixed. In the disclosed process, $SiO_2$and SiC are reacted to form molten silicon, SiO, and CO, the SiO then being contacted with the bed of carbon to regenerate SiC. The furnace used in this process is similar to the two-stage furnace described in the process for the present invention.

SUMMARY OF INVENTION

The present invention is a batch process for the smelting of ferrosilicon whereby energy normally lost from the smelting process as CO is used to prereduce typically high energy requiring feedstock materials. This improvement is achieved by using a two-stage furnace, in which CO emitted from the smelting process of the first stage flows through a bed of particles containing higher oxides of iron, placed in the second stage. The CO reduces the higher iron oxides comprising mainly $Fe_2O_3$ and $Fe_3O_4$ to FeO. These prereduced particles when subsequently added to the first stage of the smelting furnace require significantly less electrical energy to reduce to elemental iron. The use of energy normally lost from the smelting process to effect a prereduction of higher oxides of iron makes economically feasible the use of low cost, but high energy requiring, feed stocks such as tailings from iron ore concentration. The tailings can also serve as a low cost source of silicon dioxide, thus resulting in even greater savings. The closed furnace configuration allows containment of CO for the reduction process and allows the use of iron oxide containing particles of small size.

DESCRIPTION OF THE DRAWING

Figure 1:
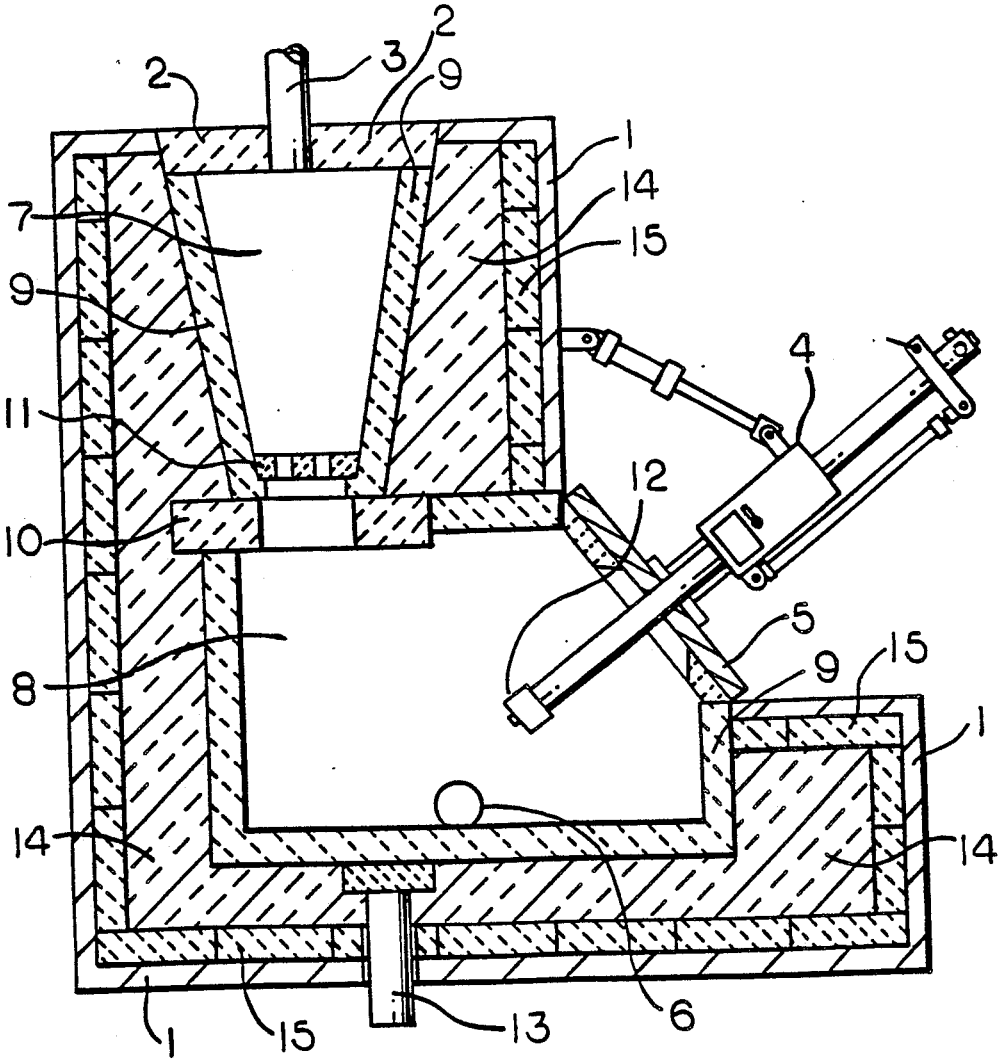
FIG. 1 is a cross-sectional view of an example of a two-stage closed furnace which may be used iu the process of the present invention.

In FIG. 1, the assembled two-stage furnace is shown enclosed by a steel shell 1. The furnace consists of a lower first stage furnace body 8 and an upper second stage shaft 7. An electric energy source, assembly 4, enters the first stage 8 at the end of the furnace body opposite the shaft through a water-cooled panel 5. The second stage shaft 7 and the furnace body 8 are lined with carbon paste 9. The second stage shaft 7 is a truncated cone which is supported above the furnace body 8 by graphite blocks 10. Cover 2 is in place on the second stage shaft 7 to keep the system closed during furnace operation. The cover 2 is connected by a gas outlet line 3 for removing the remaining by-product gases from the furnace. The cover 2 is disconnected at gas outlet line 3 and removed for loading of feed materials to the lower first stage. A perforated graphite support plate 11 is positioned at the bottom of the second stage shaft. The graphite plate 11 retains particulates in the second stage 7 so gases evolved from the reaction in the first stage 8 can pass through the particulates and react with them. At the end of an operating cycle, the support plate 11 is broken with a stoking rod allowing the particulates of the second stage 7 to pass into the first stage of the furnace 8. Additional materials to be charged to the furnace are place into the second stage shaft 7 and allowed to pass into the first stage 8. An anode 13 is positioned at the bottom of the first stage Ferrosilicon is removed from the first stage 8 via a tapping spout 6. The furnace body 8 and shaft 7 are enclosed, from inside to outside, by first a layer of chrome-alumina refractory 14. This layer of refractory is followed by a layer of insulating brick 15. The entire assembly is then encased by the steel shell 1.

DESCRIPTION OF THE INVENTION

The present invention is a batch process for the production of ferrosilicon, which utilizes carbon monoxide (CO) emitted from the smelting process in a first stage of a furnace to prereduce particles containing higher oxides of iron, for example, $Fe_2O_3$ and $Fe_3O_4$, contained in a second stage of the furnace.

The process of the present invention employs a closed two-stage furnace. The first stage of the furnace contains an energy source. The second stage is attached to the first stage by a means suitable for retaining solid particulates in the second stage and allowing gases from the first stage to pass through the contained particles. The process comprises:

a. Combining into the first stage of the furnace a feed mixture consisting essentially of a source of iron (Fe), a source of carbon (C), and silicon dioxide $SiO_2$).
b. Loading the second stage of the furnace with particles containing the higher oxides of iron.
c. Applying energy to the first stage sufficient to effect conversion of the feed mixture to molten silicon and iron and to gaseous CO; the gaseous CO contacting the particles contained in the second stage and reducing the higher oxides of iron.
d. Recovering the molten silicon and iron from the first stage as a ferrosilicon alloy.
e. Loading the reduced higher oxides of iron formed in the second stage, along with silicon dioxide and a source of carbon to the first stage.
f. Loading the second stage of the furnace with higher oxides of iron.
g. Repeating steps c through f.

The configuration of the two-stage silicon smelting furnace of the present invention facilitates efficient operation of a two-step process in which particulate higher oxides of iron are reduced concurrently but in a stage separated from the reaction zone of the furnace where molten ferrosilicon is formed. The general configuration and construction of the furnace body is similar to that for conventional smelting furnaces. However, in the present invention the furnace is divided into two separate but interconnecting stages. The first stage contains an energy source and is the stage in which the actual smelting process occurs. The second stage of the furnace is a shaft for retaining a bed of particles containing higher oxides of iron. The shaft comprising the second stage is attached to the first stage by such means as to minimize loss of heat and to allow CO emitted from the smelting process to pass through the particulate bed effecting reduction of the higher oxides of iron.

The shaft which is positioned above the furnace body can be any vertical, open configuration such as, for example, a cylinder, a shaft with a square or rectangular cross-section, a structure with sloping sides such as a truncated cone. A truncated cone is a preferred configuration for the shaft.

The design of the shaft has significant impact upon the efficient conversion of higher oxides of iron such as $Fe_2O_3$ and $Fe_3O_4$ to FeO. Those skilled in the art of gas/solid reactor design recognize the need to control such factors as: (1) particle size of the solids within a shaft and (2) relative height and cross-sectional area of the shaft to effect the necessary superficial velocities and residence times of gases within the shaft to achieve efficient conversion of higher oxides of iron to FeO.

For the purposes of the instant invention, the height of the shaft will be represented by "H," and the cross-sectional dimension will be represented by "D." The inventors believe that an H/D ratio of about 1 is effective. Higher H/D ratios may be effectively used, but supplemental heating of the shaft may be required to effect the reduction process. A limiting factor on the H/D ratio is the pressure drop through the bed of particles containing the higher oxides of iron.

As the scale of production increases, the needed H/D ratio to maintain corresponding superficial velocities and residence times would decrease. However, a minimum H/D ratio would have to be maintained to reduce channelling of gases through the bed of solids and to assure sufficient contact of gaseous CO with the solid particles containing the higher oxides of iron. The inventors believe that a shaft H/D ratio in the range of from about 0.1 to 10 is effective for the instant invention.

Supplemental heating of the shaft can be effected by such known means as, for example, resistance or inductive heating.

The energy source can be known means such as, for example, an open or submerged graphite electrode or a transferred arc plasma torch, either source coupled with an anode within the furnace body. The electricity utilized by the energy source can be direct current or single or multiphase alternating current. The preferred energy source is a direct current transferred arc plasma torch. The plasma gas can be, for example argon hydrogen, or mixtures thereof. To effect efficient transfer of thermal energy within the silicon smelting furnace of the instant invention, it is preferred that the electrode or plasma torch should be movably mounted within the furnace body.

The means for supporting solid particles containing higher oxides of iron can be any conventional means which will effectively hold the solids while allowing by-produced CO from the first stage of the furnace to pass up through the shaft of the second stage, for example a perforated plate.

The molten ferrosilicon can be collected by such conventional means as, for example, batch or continuous tapping. Means for collecting molten silicon could be effected, for example at an opening in the bottom of the furnace body or at a location low in a wall of the furnace body.

The first stage of the furnace is charged with $SiO_2$, a source of iron, and a stoichiometric quantity of carbon sufficient to reduce the SiO and iron to elemental silicon and iron. Applying of energy to the furnace results in the formation of molten silicon, which is readily soluble in the molten iron, resulting in the formation of ferrosilicon alloy and carbon monoxide (CO) gas. The emitted CO gas passes through a second stage of the furnace loaded with particles containing higher oxides of iron. The higher oxides of iron comprises those of the general formula $Fe_xO_y$ where x is greater than one and y is greater than two, are reduced to iron monoxide (FeO) by the emitted CO. The ferrosilicon is tapped from the first stage of the furnace. The particles from the second stage of the furnace, containing the reduced higher oxides of iron are then introduced into the first stage of the furnace. A preferred method for doing this is to use a stoking rod to break a perforated graphite plate used at the bottom of the second stage to retain the oxide containing particles in the second stage. Additional feed materials comprising, as needed, sources of silicon dioxide, iron, and carbon are then poured through the void created in the second stage by the stoking rod. As the additional materials pass through the void they pull the particles containing the reduced higher oxides of iron into the first stage while creating a mixing action. A new graphite separation plate is placed at the bottom of the second stage of the furnace and an additional quantity of a source of the higher oxides of iron is added to the second stage. The process as described is repeated on a batch basis.

The carbon which is loaded into the first stage of the furnace can be, for example, carbon black, charcoal, coal, or coke. The form of the carbon can be, for example, powder, granule, chip, lump, pellet, and briquette. The perforated graphite plate as described, supra, is considered a source of carbon when considering the quantity of carbon to be added to the process. Carbon content from the decomposition of graphite electrodes should also be considered as a source of carbon when considering the quantity of carbon to be added to the process. In general two moles of carbon are added for each mole of silicon dioxide and one mole of carbon for each mole of FeO. A preferred, but not limiting molar range of carbon is $\pm 10\%$ of the stoichiometric quantity.

The source of the silicon dioxide ($SiO_2$) which is fed to the first stage of the furnace can be, for example, quartz in its many naturally occurring forms (such as sand); fused and fume silicon, precipitated silica, and silica flour in their many forms; and silicon dioxide containing iron ores. The form of the silicon dioxide source can be, for example, powder, granule, lump, pebble, pellet, and briquette.

The initial charge of iron to the first stage of the furnace can be in the form of iron scraps, shavings or filings. Alternatively, oxides of iron comprising iron monoxide (FeO) and higher oxides of iron, for example, ferric oxide ($Fe_2O_3$), and ferrous oxide ($Fe_3O_4$) or mixtures thereof may be used. The initial charge of oxides of iron to the first stage of the furnace can be added as iron oxide containing ores or their tailings, for example, taconite, magnetite hematite, and limonite. Tailings are the iron oxide containing remains from ore concentration procedures. When the initial charge of iron to the first stage of the furnace is oxides of iron, a stoichiometric quantity of carbon, as described, supra, is added to effect the reduction of the oxides of iron to elemental iron. The inventors do not consider the source of the initial charge of iron to be critical to the present invention.

Higher oxides of iron, for example, ferric oxide ($Fe_2O_3$) and ferrous oxide ($Fe_3O_4$), are added to the second stage of the furnace. A preferred source for the higher oxides of iron is iron oxide containing ores or their tailings, for example, taconite, magnetite, hematite, and limonite. The size of the particles containing the higher oxides of iron is important in that the particles must be small enough that CO can permeate into the particle and effect significant reduction of the higher oxides of iron present. By significant reduction is meant, that at least 10 weight percent of the higher oxides of iron present in the particle are reduced. Preferred are particles less than 0.25 inch by down. More preferred are particles less than about 0.1 inch by down. For economical reasons, the concentration of higher oxides of iron in the iron oxide containing ore should be greater than about 5 weight percent. Preferred are ores containing the higher oxides of iron at a concentration of about 5 to 40 weight percent. Most preferred are ores containing the higher oxides of iron at a concentration of about 10 to 20 weight percent.

The quantity of iron or iron oxide added to the first and second stages of the furnace will depend upon the concentration of iron required in the ferrosilicon alloy. A range of about 10 to 55 weight percent iron in the ferrosilicon is preferred. More preferred are concentrations of about 25 and 50 weight percent iron in the ferrosilicon alloy. Additional silicon dioxide may be added to the first stage of the furnace to adjust the final composition of the ferrosilicon alloy produced.

When running the present process, it may be desirable to place a quantity of the stoichiometrically required amount of carbon in the second stage of the furnace. This can facilitate the capture of silicon monoxide gas (SiO) evolved from the first stage by the following reaction:

$$SiO + C = SiC + CO \quad (5)$$

The silicon carbide (SiC) is a solid at the temperature of the second stage of the furnace and can be returned to the first stage of the furnace along with the reduced higher oxides of iron. The SiC then reacts in the first stage according to the following equations:

$$2SiO_2 + SiC = 3SiO + CO \quad (6)$$

$$SiO + SiC = 2Si + CO \quad (7)$$

Preferred is a process where about 50 to 100 weight percent of the stoichiometric quantity of carbon is present in the first stage of the furnace and the remaining 0 to 50 weight percent of the stoichiometric quantity of carbon is present in the second stage of the furnace. More preferred is a process where about 90 weight percent of the stoichiometric quantity of carbon is present in the first stage of the furnace and the remaining about 10 weight percent of the stoichiometric quantity of carbon is present in the second stage of the furnace. The carbon placed in the second stage of the furnace should be layered separate from the particles containing the higher oxides of iron and in such a location that the gases emitted from the first stage contact the carbon layer prior to contacting the iron oxide containing particles.

So that those skilled in the art may better understand and appreciate the present invention the following example is presented. The example is presented to be illustrative and is not to be construed as limiting the claims delineated herein.

EXAMPLE 1

The ability to use a two-stage furnace to capture the chemical energy of reaction emitted gases from ferrosilicon smelting was demonstrated. In this example, silicon monoxide (SiO) emitted during the reduction of silicon dioxide ($SiO_2$) to silicon (Si) was further reduced to silicon carbide (SiC) by passing the gaseous SiO through a carbon bed retained in the second stage of the furnace. The reaction in the second stage prevented the loss of energy used to reduce $SiO_2$to SiO. Briquetted taconite tailings placed in the first stage of the furnace were used as a source of iron and silicon dioxide.

A closed smelting furnace similar to that described in FIG. 1, supra, was assembled. The first stage of the furnace had dimensions of 850 mm by 380 mm at the base and 350 mm in height. The second stage of the furnace was a shaft in the form of a truncated cone positioned at an opening at one end of the top of the first stage. The cone was about 450 mm in height with an inside diameter of 225 mm at the juncture with the first stage, tapering to an inside diameter of about 340 mm at the top of the cone. Pieces of graphite plate were positioned inside the shaft parallel to the outside edge of the cone to produce a semicircular cross section to the cone. The resultant shaft configuration approximated a truncated cone starting with a diameter of about 100 mm at the juncture with the first stage tapering to an inside diameter of about 300 mm at the top. A perforated graphite plate was placed above the opening of the first stage at the bottom of the shaft to support particulate carbon while allowing by-product gases to contact the particulates to form silicon carbide.

A plasma torch was used as the energy source. The plasma torch was a 100 kW direct current transferred arc unit manufactured by Voest-Alpine, Linz, Austria. The plasma torch was mounted so that the cathode could be inserted or retracted along its vertical axis. Additionally, the plasma torch was mounted so that the cathode could pivot from a horizontal position to positions below the horizontal.

A spout for tapping molten metal exited the side of the furnace body, near the bottom, at a location essentially below the shaft.

The raw materials utilized were silicon, silicon dioxide, charcoal, and taconite tailings. The silicon dioxide was Bear River Quartz from California. The quartz had a particle size that was primarily in the range of 1.9 to 2.5 cm. The charcoal was Austrian hardwood charcoal with a particle size primarily in the range of 3.0 to 6.5 mm. The taconite consisted of tailings of which 70% passed through a 50 mesh screen. The taconite was briquetted using starch as a binder. A typical analysis of the briquetted taconite tailings is presented in Table 1.

TABLE 1

Analysis of Briquetted Taconite Tailings

| Oxide Content | Wt. % |
|---|---|
| FeO | 11.35 |
| $Fe_2O_3$ | 18.88 |
| $SiO_2$ | 56.40 |
| $Al_2O_3$ | 0.40 |
| MnO | 0.95 |
| CaO | 3.82 |
| MgO | 2.63 |
| Remainder | Starch; $H_2O$, Misc. |

The plasma torch was operated at an argon flow rate of 1.4 $Nm^3/h$ during the first 12 hour heating up period. The argon ilow rate was reduced to 0.9 Nm /h for the remainder of the run. During the first 56 hours of smelting the process was run without the addition of taconite.

The furnace was initially loaded with an equimolar mixture of $SiO_2$and Si. The $SiO_2$/Si mixture was charged to the first stage of the furnace through the shaft comprising the second stage, which at this time did not contain a support plate. The $SiO_2$/Si mixture was allowed to react to generate gaseous SiO. The gaseous SiO further preheated the furnace. This process was repeated a second time. A graphite support plate was then placed in the shaft separating the first stage from the second stage. The shaft comprising the second stage was charged with from about 0.4 to 7.1 kg of charcoal depending upon the stoichiometric requirements of the reaction.

The reaction occurring in the first stage was monitored by a temperature probe. When the temperature began to rise excessively, the reaction in the first stage was judged to have gone to completion. Then, the cover of the shaft was removed and the contents of the shaft were charged to the first zone of the furnace by breaking the support plate with a stoking rod. Once the support plate was broken, a void was produced in the bed of SiC particulate $SiO_2$was poured through the void pulling SiC into the flowing $SiO_2$stream, effecting mixing of the SiC and $SiO_2$. At equilibrium conditions, about 8.0 kg of $SiO_2$ was added to the first stage by this method at each charge. A new support plate was placed into the shaft and a quantity of about 4.0 kg of charcoal was charged to the shaft. The broken graphite support plates were also added to the furnace body and were considered a part of the total carbon feed. The shaft was again sealed, and the run proceeded. This cycle was repeated every 1½ to 2 hours over a 56 hour period. Molten silicon was first tape from the furnace after 18 hours of running the process and thereafter at the end of each cycle.

Table 2 is a summary of the steady state smelting results obtain by this procedure.

TABLE 2

| Steady State Smelting Results | | | | |
|---|---|---|---|---|
| Time Period (Hours) | 25–56 | 34–56 | 40–56 | 56–74* |
| Silicon Yield (%) | 63 | 71 | 80 | 80 |
| Energy Consumption (kWh/kg) | 74 | 65 | 56 | 34 |
| Rate Si Production (kg/h) | 1.37 | 1.56 | 1.66 | 2.57 |

*ferrosilicon results

The results in Table 2 are expressed as the average value for the time period listed.

The process was continued for another 18 hours as described, supra, with the exception that briquetted taconite was also added to the first stage of the furnace. The briquetted taconite was similar to that described in Table 1, supra. The quantities of $SiO_2$and taconite added to the furnace at each charge were adjusted such that the resultant ferrosilicon alloy was approximately 75% silicon.

Over the 18 hour smelting period a total of 59 kg of taconite briquettes were smelted with 23 kg quartz to give 26 kg of ferrosilicon alloy. The power input over this period averaged 97 kW. The ferrosilicon yield was 80% at an energy consumption of 34 kWh/kg ferrosilicon. The ferrosilicon production rate was 2.57 kg/h. The carbon bed conversion to silicon carbide with taconite tailings was less than 50% as expected. This was due to production of ferrosilicon at a lower SiO partial pressure compared to silicon smelting.

What is claimed is:

1. A process for preparing ferrosilicon in a closed two-stage furnace, the first stage of the furnace containing an energy source and the second stage being attached to the first stage by a means suitable for retaining solid particles in the second stage and allowing gases from the first stage to pass through the contained particles, said process comprising:

a. combining into the first stage of the furnace a feed mixture consisting essentially of a source of iron, a source of carbon, and silicon dioxide;

b. loading the second stage of the furnace with particles containing higher oxides of iron;

c. applying energy to the first stage sufficient to effect conversion of the feed mixture to molten silicon and iron and to gaseous carbon monoxide; the gaseous carbon monoxide contacting the particles contained in the second stage and reducing the higher oxides of iron;

d. recovering the molten silicon and iron from the first stage as a ferrosilicon alloy;

e. loading the reduced higher oxides of iron formed in the second stage, along with silicon dioxide and a source of carbon to the first stage;

f. loading the second stage of the furnace with particles containing higher oxides of iron;

g. repeating steps c through f.

2. The process of claim 1, where the energy source is a transferred-arc plasma.

3. The process of claim 2, where the particles containing higher oxides of iron are tailings from iron ore concentration.

4. The process of claim 3, where the iron ore source for the tailings is selected from a group comprising taconite, magnetite, hematite, and limonite.

5. The process of claim 4, where the tailings have a particle size of less than about 0.25 inch by down.

6. The process of claim 5, where the concentration of higher oxides of iron in the tailings is greater than about 5 weight percent.

7. The process of claim 6, where the concentration of higher oxides of iron in the tailings is about 10 to 20 weight percent.

8. The process of claim 7, where the tailings are from the concentration of taconite.

9. The process of claim 8, where the higher oxide of iron is $Fe_2O_3$.

10. The process of claim 1, where the energy source is an open electric arc.

11. The process of claim 10, where the particles containing higher oxides of iron are tailings from iron ore concentration.

12. The process of claim 11, where the iron ore source for the tailings is selected from a group comprising taconite, magnetite, hematite, and limonite.

13. The process of claim 12, where the tailings have a particle size of less than about 0.25 inch by down.

14. The process of claim 13, where the concentration of higher oxides of iron in the tailings is greater than about 5 weight percent.

15. The process of claim 14, where the concentration of higher oxides of iron in the tailings is about 10 to 20 weight percent.

16. The process of claim 15, where the tailings are from the concentration of taconite.

17. The process of claim 16, where the higher oxide of iron is $Fe_2O_3$.

18. The process of claim 1, where at least a part of the silicon dioxide is provided as a component of the particles containing the higher oxides of iron.

19. The process of claim 18, where about 50 to 100 percent of the silicon dioxide is provided as a component of the iron source.

20. The process of claim 1, where the carbon is present at a quantity stoichiometrically sufficient to essentially fully reduce the silicon and iron oxides present in the first stage of the furnace.

21. The process of claim 20, where about 50 to 100 weight percent of the stoichiometric quantity of carbon is present in the first stage of the furnace and the remaining 0 to 50 weight percent of the stoichiometric quantity of carbon is present in the second stage of the furnace.

22. The process of claim 21, where the carbon present in the second stage of the furnace is separate from the particles containing the higher oxides of iron and the carbon is placed in a position to contact the gases from the first stage of the furnace before the gases contact the particles containing the higher oxides of iron.

23. The process of claim 22, where about 90 weight percent of the stoichiometric quantity of carbon is present in the first stage of the furnace and the remaining about 10 weight percent of the stoichiometric quantity of carbon is present in the second stage of the furnace.

24. The process of claim 1, where the ferrosilicon alloy is about 45 to 90 weight percent silicon.

25. The process of claim 24, where the ferrosilicon alloy is about 50 weight percent silicon.

26. The process of claim 24, where the ferrosilicon alloy is about 75 weight percent silicon.

27. The process of claim 1, where the energy source is a submerged electric arc.

28. The process of claim 1, where the energy source is a direct current.

* * * * *